US010145050B2

(12) United States Patent
Lee

(10) Patent No.: US 10,145,050 B2
(45) Date of Patent: Dec. 4, 2018

(54) DESCALING DEVICE OF WASHING MACHINE

(71) Applicant: Meng-Lan Lee, Taipei (TW)

(72) Inventor: Meng-Lan Lee, Taipei (TW)

( * ) Notice: Subject to any disclaimer, the term of this patent is extended or adjusted under 35 U.S.C. 154(b) by 0 days.

(21) Appl. No.: 15/495,277

(22) Filed: Apr. 24, 2017

(65) Prior Publication Data

US 2017/0327993 A1 Nov. 16, 2017

(30) Foreign Application Priority Data

May 16, 2016 (TW) ..... 105115034 A

(51) Int. Cl.

| | |
|---|---|
| ***D06F 39/06*** | (2006.01) |
| ***D06F 35/00*** | (2006.01) |
| ***D06F 23/04*** | (2006.01) |
| ***A46B 7/02*** | (2006.01) |
| ***A46B 13/02*** | (2006.01) |
| *B08B 9/087* | (2006.01) |
| *B08B 9/08* | (2006.01) |
| *B08B 9/023* | (2006.01) |
| *B08B 9/36* | (2006.01) |

(52) U.S. Cl.

CPC ..... *D06F 39/06* (2013.01); *A46B 7/02* (2013.01); *A46B 13/02* (2013.01); *D06F 23/04* (2013.01); *D06F 35/008* (2013.01); *A46B 2200/3073* (2013.01); *B08B 9/023* (2013.01); *B08B 9/087* (2013.01); *B08B 9/0808* (2013.01); *B08B 9/36* (2013.01)

(58) Field of Classification Search

CPC ..... D06F 39/06; D06F 35/008; D06F 23/04; A46B 7/02; A46B 13/02; A46B 2200/3073; B06B 9/087; B06B 9/0808; B06B 9/36

See application file for complete search history.

(56) References Cited

U.S. PATENT DOCUMENTS

| | | | | |
|---|---|---|---|---|
| 6,145,350 | A | 11/2000 | Hwang | |
| 8,997,532 | B2 | 4/2015 | Atkinson | |
| 2010/0175432 | A1* | 7/2010 | Komori | D06F 25/00 68/20 |
| 2010/0212367 | A1* | 8/2010 | Kim | D06F 25/00 68/19 |
| 2010/0212368 | A1* | 8/2010 | Kim | D06F 25/00 68/19 |

(Continued)

FOREIGN PATENT DOCUMENTS

| | | | |
|---|---|---|---|
| JP | 2004073784 | A * | 3/2004 |
| JP | 2004141587 | A * | 5/2004 |
| JP | 2016086976 | A * | 5/2016 |

(Continued)

*Primary Examiner* — Joseph L. Perrin
(74) *Attorney, Agent, or Firm* — Winston Hsu

(57) ABSTRACT

A descaling device is disposed in a washing machine for descaling. The descaling device includes a main body and a descaling assembly. The descaling assembly includes a connecting rod and a descaling rod which are connected to each other. The connecting rod is linked by the main body to rotate. The descaling rod is bent at an angle relative to the connecting rod. The descaling rod is a brush. The descaling rod is linked by the connecting rod to rotate for descaling. The descaling device can descale and clean a larger area of the inner and outer tanks of the washing machine efficiently.

13 Claims, 13 Drawing Sheets

(56) References Cited

U.S. PATENT DOCUMENTS

| | | | | |
|---|---|---|---|---|
| 2013/0127263 | A1* | 5/2013 | Park | B08B 3/04 310/10 |
| 2017/0067202 | A1* | 3/2017 | Hsu | A46B 5/00 |

FOREIGN PATENT DOCUMENTS

| | | | |
|---|---|---|---|
| TW | M472073 | U | 2/2014 |
| TW | M529715 | U | 10/2016 |

* cited by examiner

DESCALING DEVICE OF WASHING MACHINE

FIELD OF THE INVENTION

The present invention relates to a descaling device of a washing machine, and more particularly to a descaling device for descaling and cleaning the inner and outer tanks of the washing machine.

BACKGROUND OF THE INVENTION

A washing machine is a machine that uses water to wash clothing and sheets. Laundry detergent is frequently used to clean clothes. In modem automation machinery and technology, the water in the washing machine can fully agitate the clothing in the tank of the washing machine to improve the cleaning effect. After the clothing is washed, the lid of the washing machine is usually covered. The tank of the washing machine is in a non-ventilated and humid state, which easily lets the dirt attached to the tank multiply the bacteria. This will pollute the subsequent clothing to be washed. Even if the clothing has been washed, the laundry may have an odor or result in skin itching, allergy, gynecological problems and other issues. In view of the necessity of cleaning the existing washing machine, a descaling device for a washing machine is developed accordingly.

A conventional descaling structure of a washing machine is disclosed as shown in FIG. 1 (referring to Taiwan Patent No. M472073). A washing machine 90 has a machine body 91. The machine body 91 includes an outer tank 92 and an inner tank 93 disposed in the outer tank 92. The inner tank 93 has a plurality of perforations 931. The inner tank 93 is rotated by a transmission mechanism of the washing machine 90 for laundering clothes. Each of the perforations 931 of the inner tank 93 is provided with a descaling brush 94. The descaling brush 94 is composed of a fixing member 941 and a bristle member 942. The fixing member 941 is positioned on the inner tank 93. The bristle member 942 passes through the perforation 931 of the inner tank 93 to get contact with the outer tank 92. When the inner tank 93 is rotated in the machine body 91, the descaling brush 94 provided on the inner tank 93 is used to remove the dirt and stain of the inner wall surface of the outer tank 92 to achieve the descaling effect of the outer tank 92 of the washing machine 90.

The conventional descaling structure is able to descale and clean the inner wall of the outer tank of the washing machine, but it is unable to descale and clean the outer wall of the inner tank of the washing machine. Even though the bristles of the descaling brush are lengthened, the descaling brush is rotated along with the inner tank so there is no relative displacement between the descaling brush and the inner tank. It is difficult to achieve effective cleaning of the outer wall of the inner tank. The bristles extend from the perforations of the inner tank, and the area to be cleaned is limited. It is required to have more perforations for installing the descaling brushes, which is unfavorable for the user to assemble the descaling device himself.

Accordingly, the inventor of the present invention has devoted himself based on his many years of practical experiences to solve these problems and develop a descaling device which is able to descale and clean the inner and outer tanks of the washing machine.

SUMMARY OF THE INVENTION

The primary object of the present invention is to provide a descaling device disposed in the inner tank of a washing machine. The descaling device includes a descaling rod which is rotated along with the rotation of the inner tank and extendable and retractable for descaling the inner and outer tanks of the washing machine.

Another object of the present invention is to provide a descaling device of a washing machine, which can be assembled and adjusted easily and conveniently.

In order to achieve the aforesaid object, the descaling device of the present invention is disposed in a washing machine for descaling an inner tank and an outer tank of the washing machine. A predetermined space is defined between the inner tank and the outer tank. The descaling device comprises a main body and a descaling assembly. The main body is located in the inner tank. The main body is lashed by water to rotate when in use. The descaling assembly includes a connecting rod and a descaling rod which are connected to each other. The connecting rod is linked by the main body to rotate. The descaling rod is bent at an angle relative to the connecting rod. The descaling rod is linked by the connecting rod to rotate for descaling.

Preferably, the descaling rod is a brush, and the brush is formed of a bristle brush, a sponge, or a fiber fabric.

Preferably, the main body has a through hole therein.

Preferably, the main body includes a plurality of raised blades having a spiral curved shape.

Preferably, the descaling device further comprises a shaft member. The shaft member is in a tubular shape and has a shaft hole. The shaft member is inserted in the through hole in a tightly engaged state. The connecting rod is inserted in the shaft hole. The connecting rod is extendable and retractable relative to the shaft hole through an external force.

Preferably, the shaft member includes a connecting portion inserted in the through hole. The connecting portion is connected with an annular engaging portion. The annular engaging portion is connected with a pivot portion. The shaft hole of the shaft member penetrates through the connecting portion, the annular engaging portion, and the pivot portion.

Preferably, the descaling device further comprises a bearing. The pivot portion is pivotally connected to the bearing.

Preferably, the descaling device further comprises an adjustment member. The adjustment member has a first raised ring and a second raised ring at inner and outer ends thereof. At least one engaging recess is formed between the first raised ring and the second raised ring for engaging with a perforation of the inner tank.

Preferably, the descaling rod is a multi-rod configuration.

Preferably, a hinge is connected between the connecting rod and the descaling rod, enabling the descaling rod to rotate or swing freely relative to the connecting rod.

Preferably, another end of the descaling rod, opposite to the hinge, is provided with a second hinge. The second hinge is pivotally connected with a second descaling rod. The second descaling rod is a brush.

Preferably, the connecting rod is further connected with an auxiliary descaling rod opposite an inner side of the descaling rod. The auxiliary descaling rod is bent at an angle relative to the connecting rod. The auxiliary descaling rod is a brush. The auxiliary descaling rod is provided with an auxiliary hinge disposed at an adjoining end of the auxiliary descaling rod relative to the connecting rod.

Preferably, the connecting portion is provided with an auxiliary fixing segment adjacent to the annular engaging portion. An auxiliary fixing member is provided corresponding to the auxiliary fixing segment. The auxiliary fixing member is fitted on the connecting portion to engage with or disengage from the auxiliary fixing segment.

DESCRIPTION OF THE PREFERRED EMBODIMENTS

Figure 1:
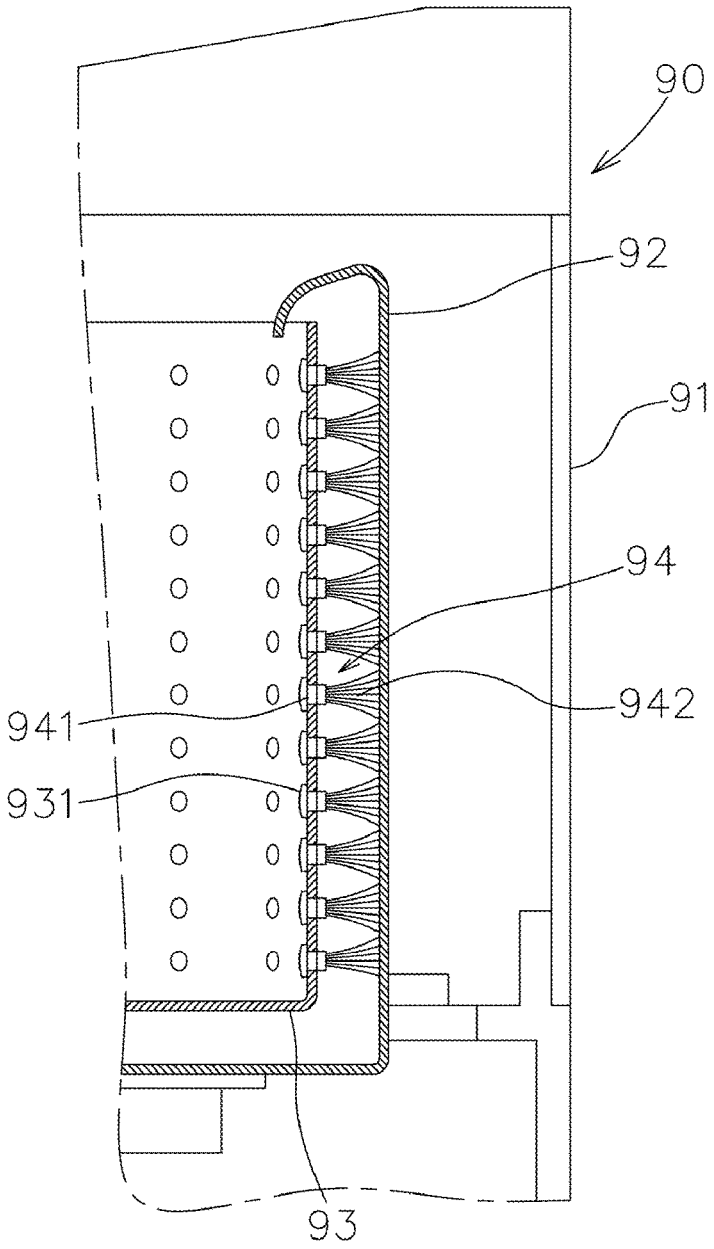
FIG 1 PRIOR ART
FIG. 1 is a schematic view of the descaling structure of a conventional washing machine.

Advantages and features of the inventive concept and methods of accomplishing the same may be understood more readily by reference to the following detailed description of embodiments and the accompanying drawings. The inventive concept may, however, be embodied in many different forms and should not be construed as being limited to the embodiments set forth herein. In the drawings, the relative sizes of elements should not be construed as being limited to the proportion and arrangement relationship as shown in the drawings and may be exaggerated for clarity, without departing from the spirit and scope of the present invention.

Figure 2:
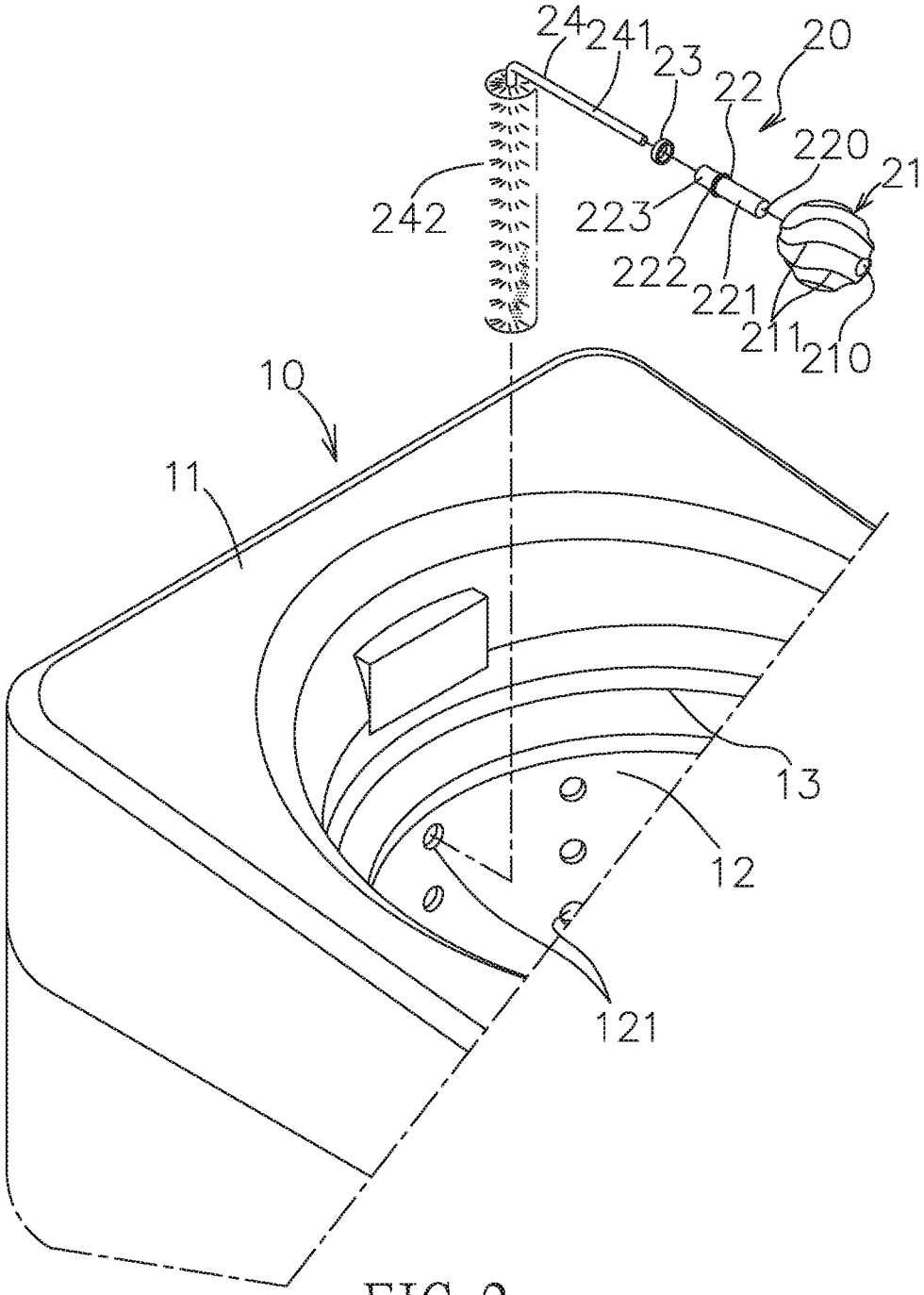
FIG. 2 is a partial perspective view in accordance with a first embodiment of the present invention.
Figure 3:
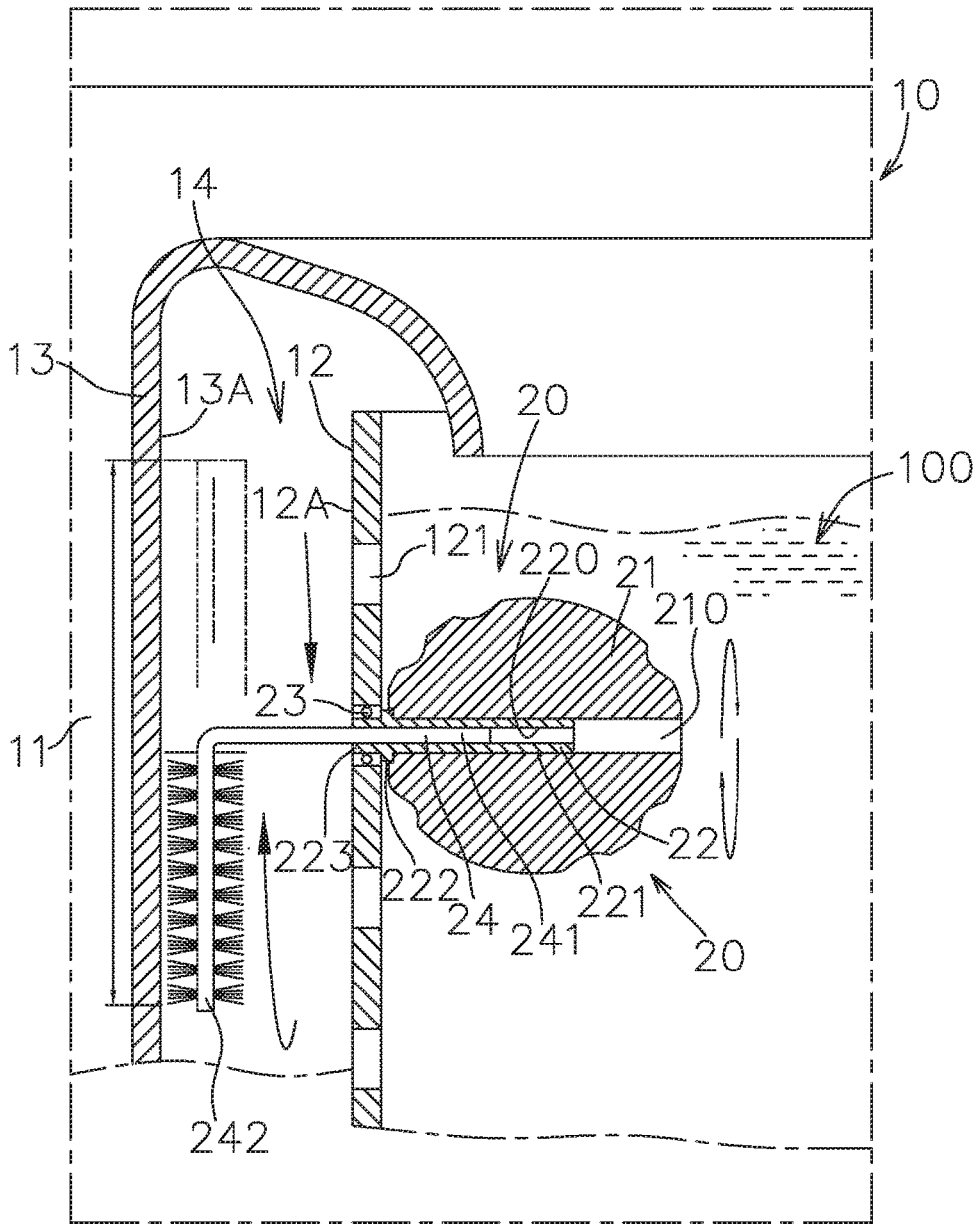
FIG. 3 is a first sectional schematic view in accordance with the first embodiment of the present invention.
Figure 4:
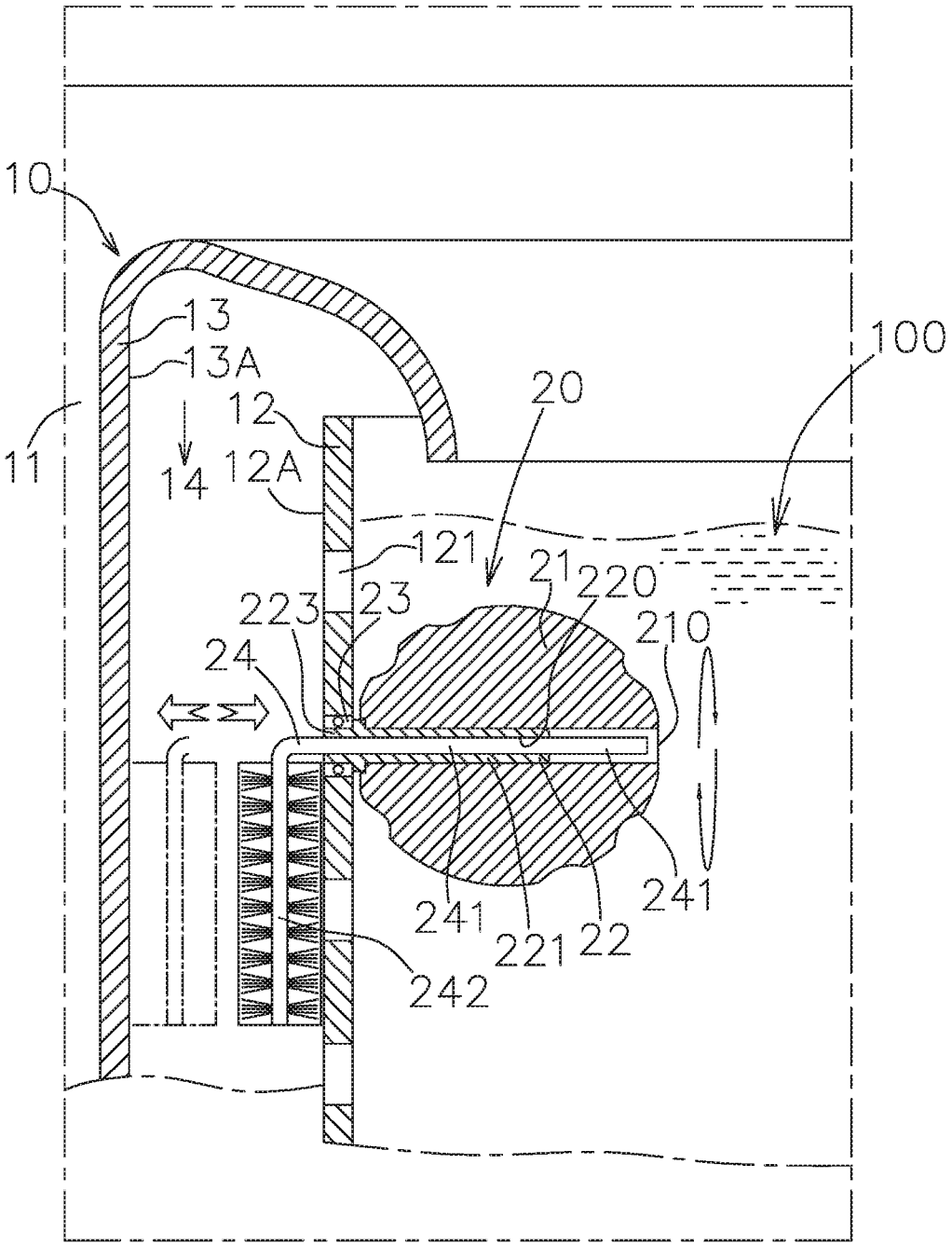
FIG. 4 is a second sectional schematic view in accordance with the first embodiment of the present invention.

FIG. 2 to FIG. 4 illustrates a first embodiment of the present invention. The present invention discloses a descaling device 20 for a washing machine 10. The washing machine 10 comprises a machine body 11. The machine body 11 includes an outer tank 13 and an inner tank 12 disposed in the outer tank 13. A predetermined space 14 is defined between the outer tank 13 and the inner tank 12. The inner tank 12 is driven by a transmission mechanism (not shown in the drawings) of the machine body 11 to rotate for laundering clothing. The side wall of the inner tank 12 is formed with a plurality of perforations 121. The perforations 121 are in communication with the inside of the inner tank 12 and the space 14. As shown in the drawings, the outer tank 13 has an inner wall 13A. The inner tank 12 has an outer wall 12A. When the descaling device 20 is running, the inner wall 13A of the outer tank 13 and the outer wall 12A of the inner tank 12 can be descaled and cleaned.

The descaling device 20 is mounted to the inner tank 12. The descaling device 20 includes a main body 21, a shaft member 22 and a descaling assembly 24. The main body 21 is in a spherical shape, but it is not limited thereto. The main body 21 has a through hole 210 therein. The main body 21 includes a plurality of raised blades 211 having a spiral curved shape. The shaft member 22 is in a tubular shape and has a shaft hole 220. The shaft member 22 includes a connecting portion 221, an annular engaging portion 222, and a pivot portion 222 which are connected to one another. The annular engaging portion 222 is located between the connecting portion 221 and the pivot portion 223. The connecting portion 221 is longer than the pivot portion 223. The shaft hole 220 penetrates through the connecting portion 221, the annular engaging portion 222, and the pivot portion 223. When in use, the main body 21 is located in the inner tank 12 and lashed by water 100 to rotate. The connecting portion 221 is inserted into the through hole 210 of the main body 21 in a tightly engaged state. The shaft member 22 is driven or rotated along with the main body 21. The pivot portion 223 is inserted in one of the perforations 121 of the inner tank 12. A bearing 23 is provided between the pivot portion 223 and the perforation 121, that is, the perforation 121 is provided with the bearing 23. The pivot portion 223 is pivotally mounted to the bearing 23, so that the shaft member 22 is rotatable relative to the bearing 23. The annular engaging portion 222 leans against the inner side of the inner tank 12 adjacent to the perforation 121 to prevent the shaft member 22 from disengaging from the main body 21 toward the outer tank 13. The descaling assembly 24 includes a connecting rod 241 and a descaling rod 242 which are connected to each other. The descaling rod 242 is bent at an angle relative to the connecting rod 241. For example, the descaling rod 242 is perpendicularly bent (90 degrees) relative to the connecting rod 241, but the angle of bending is not limited thereto. The descaling rod 242 is a brush. The descaling rod may be formed of a bristle brush, a sponge, a fiber fabric or the like, but not limited thereto. When assembled, the connecting rod 241 is inserted in the shaft hole 220 of the shaft member 22. The descaling rod 242 is bent and located in the space 14. The connecting rod 241 is properly inserted in the shaft hole 220 so that the connecting rod 241 is driven (rotated) by the shaft member 22. Meanwhile, the connecting rod 241 may be applied with an external force to extend outward or retract inward relative to the shaft hole 220.

Referring to FIG. 4, when in use, since the inner tank 12 is filled with washing water and is driven to rotate by the transmission mechanism, the main body 21 is turned along with the inner tank 12. Meanwhile, the main body 21 is lashed by the washing water to rotate through the blades 211. Thus, the descaling assembly (the connecting rod 241 and the descaling rod 242) is rotated along with the main body 21. The rotation of the descaling rod 242 is able to descale and clean a large area of the inner tank and the outer tank. The connecting rod 241 is actuated by the centrifugal force of the inner tank 12 and the multi-directional impact of the washing water so that the connecting rod 241 can extend outward and retract inward relative to the shaft member 22. When the connecting rod 214 extends outward, the descaling rod 242 is to descale and clean the inner wall 13A of the outer tank 13. When the connecting rod 214 retracts inward, the descaling rod 242 is to descale and clean the outer wall 12A of the inner tank 12. The descaling device 20 is capable of descaling and cleaning the inner wall 13A of the outer tank 13 and the outer wall 12A of the inner tank 12 simultaneously.

Figure 5:
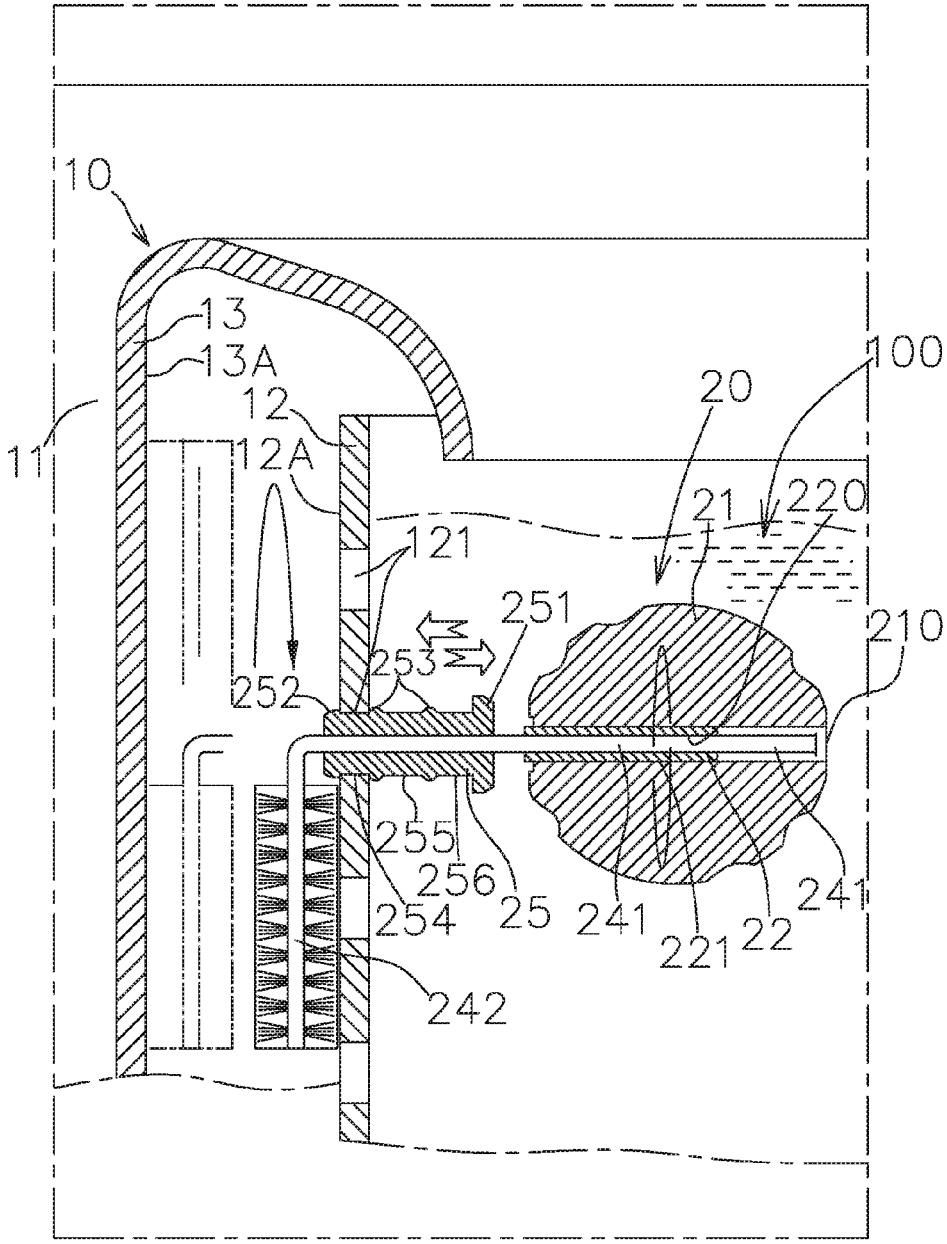
FIG. 5 is a sectional schematic view in accordance with a second embodiment of the present invention.

FIG. 5 illustrates the descaling device according to a second embodiment of the present invention. The second embodiment is substantially similar to the first embodiment with the exceptions described hereinafter. The shaft member 22 has only the connecting portion 221 of the first embodiment, that is, the shaft member 22 does not have the annular engaging portion 222 and the pivot portion 223 of the first embodiment. In other words, the shaft member 22 of this embodiment is another implementation. An adjustment member 25 is provided, instead of the bearing 23. The adjustment member 25 is mounted to the perforation 121 of the inner tank 12, which is flexible and deformable to facilitate its assembly and displacement. The adjustment member 25 has a first raised ring 251 and a second raised ring 251 at inner and outer ends thereof and a plurality of raised rings 253 between the first raised ring 251 and the second raised ring 252. In this embodiment, the number of the raised rings 253 is two, and the adjustment member 25 is formed with engaging recesses 254, 255, 256 between the first raised ring 251 and the second raised ring 252. As shown in FIG. 5, the engaging recess 254 is engaged with the perforation 121. In this way, the adjustment member 25 is selectively positioned via the engaging recesses 254, 255, 256 so that the connecting rod 241 can be extended outward and retracted inward.

Figure 6:
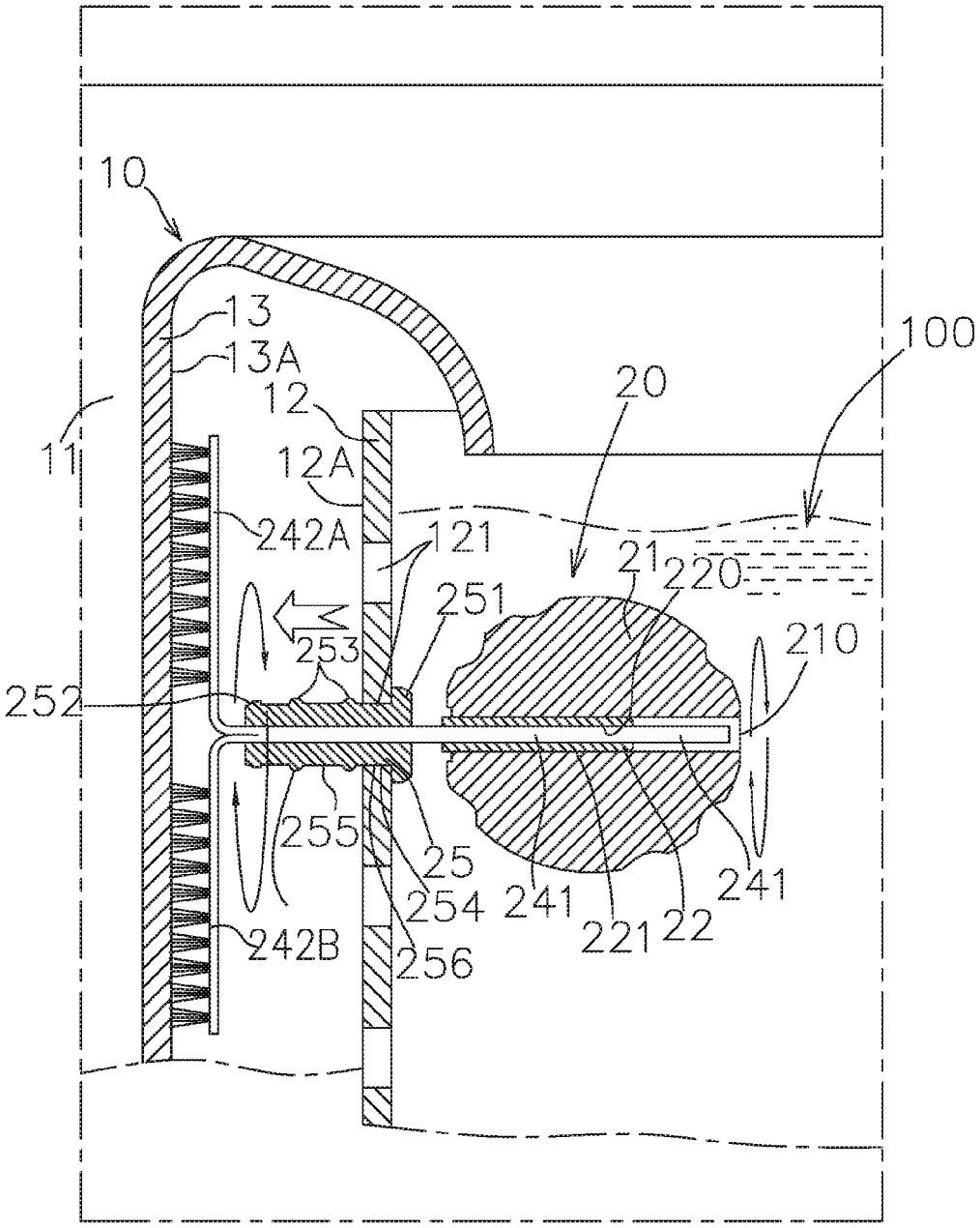
FIG. 6 is a first sectional schematic view of a modification of the second embodiment of the present invention.
Figure 7:
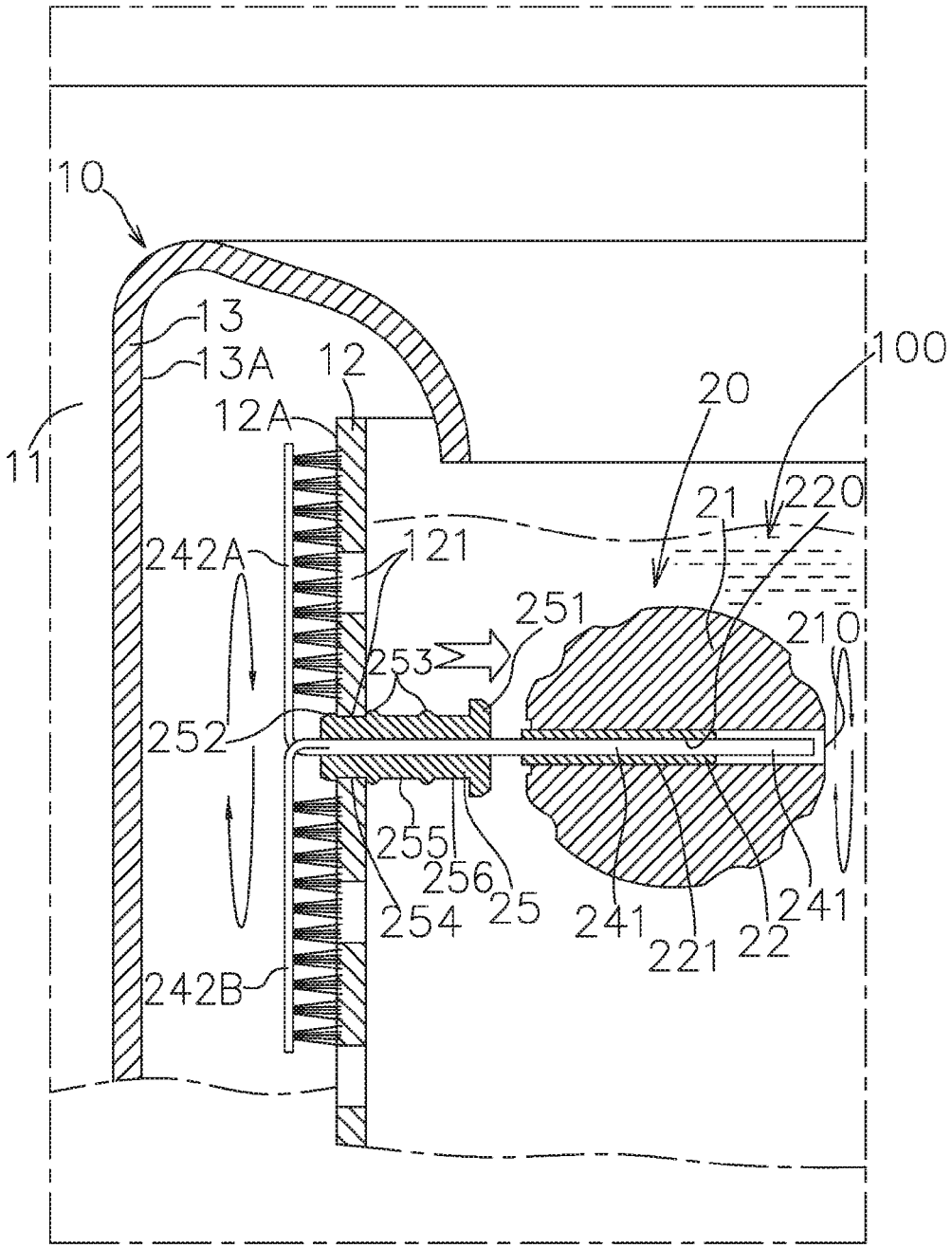
FIG. 7 is a second sectional schematic view of a modification of the second embodiment of the present invention.

FIG. 6 and FIG. 7 illustrate a modification of the descaling device of the second embodiment of the present invention. The descaling rod 242 is designed to a dual-rod configuration (or a multi-rod configuration), that is, the connecting rod 241 is connected with two descaling rods 242A, 242B which are longitudinally arranged in different directions (in opposite directions) (i.e., arranged in a straight line), but not limited thereto, to increase its descaling efficiency.

Figure 8:
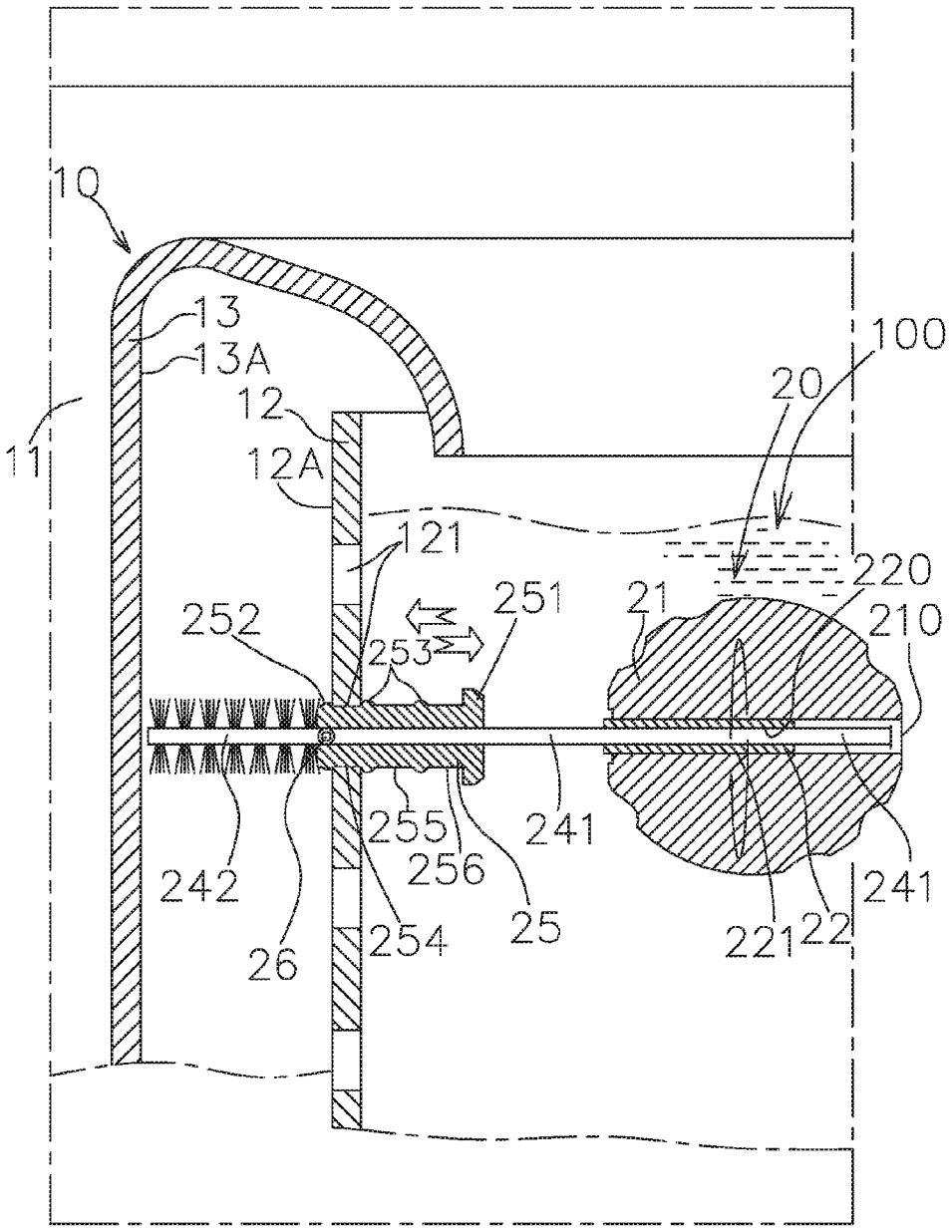
FIG. 8 is a sectional schematic view in accordance with a third embodiment of the present invention.
Figure 9:
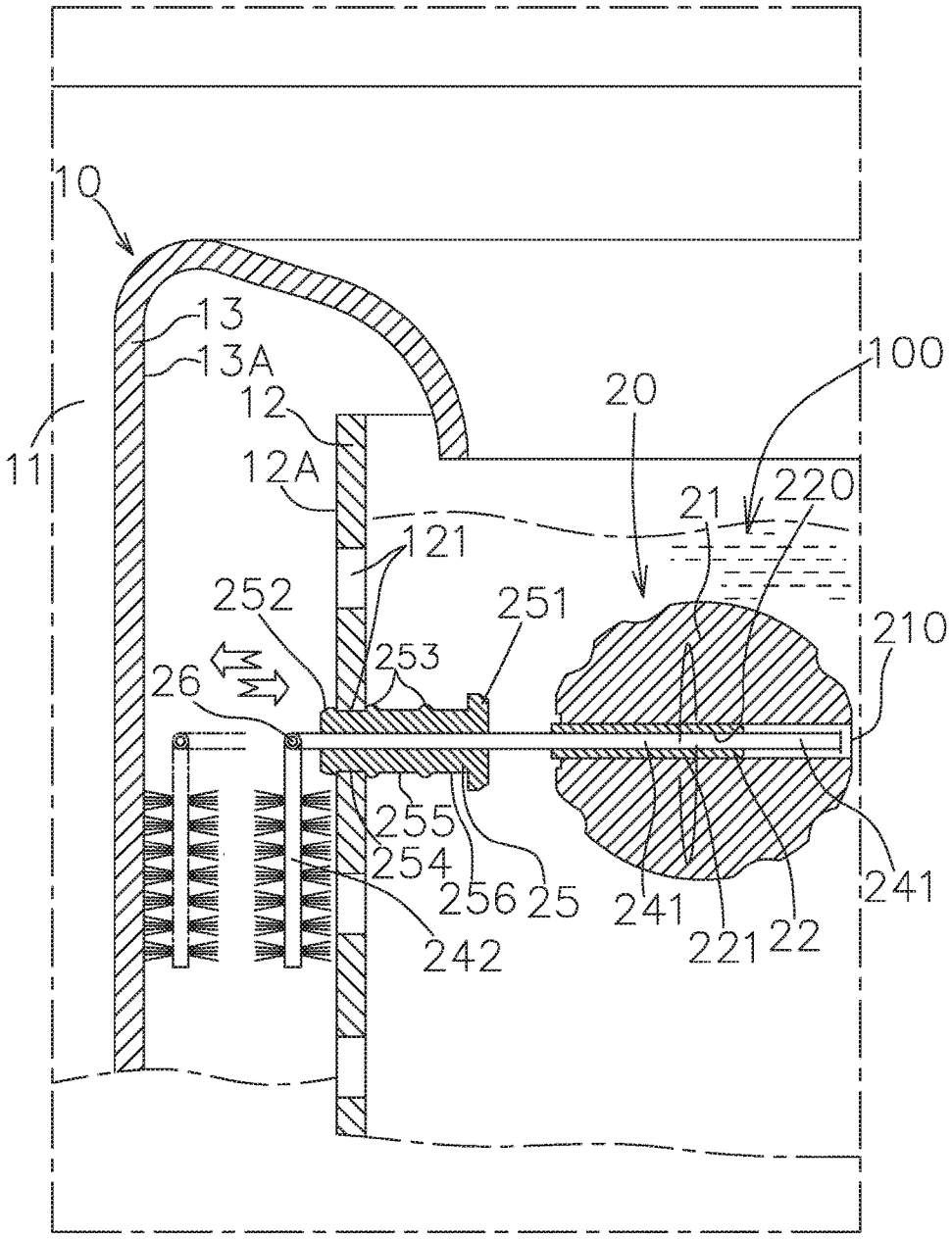
FIG. 9 is a sectional schematic view showing the operation of the third embodiment of the present invention.

FIG. 8 and FIG. 9 illustrate the descaling device according to a third embodiment of the present invention. The third embodiment is substantially similar to the second embodiment with the exceptions described hereinafter. A hinge 26 is connected between the connecting rod 241 and the descaling rod 242. The hinge 26 enables the descaling rod 242 to rotate or swing freely relative to the connecting rod 241. When the connecting rod 241 is driven or rotated along with the main body 21, the descaling rod 242 is turned or swung more flexibly.

Figure 10:
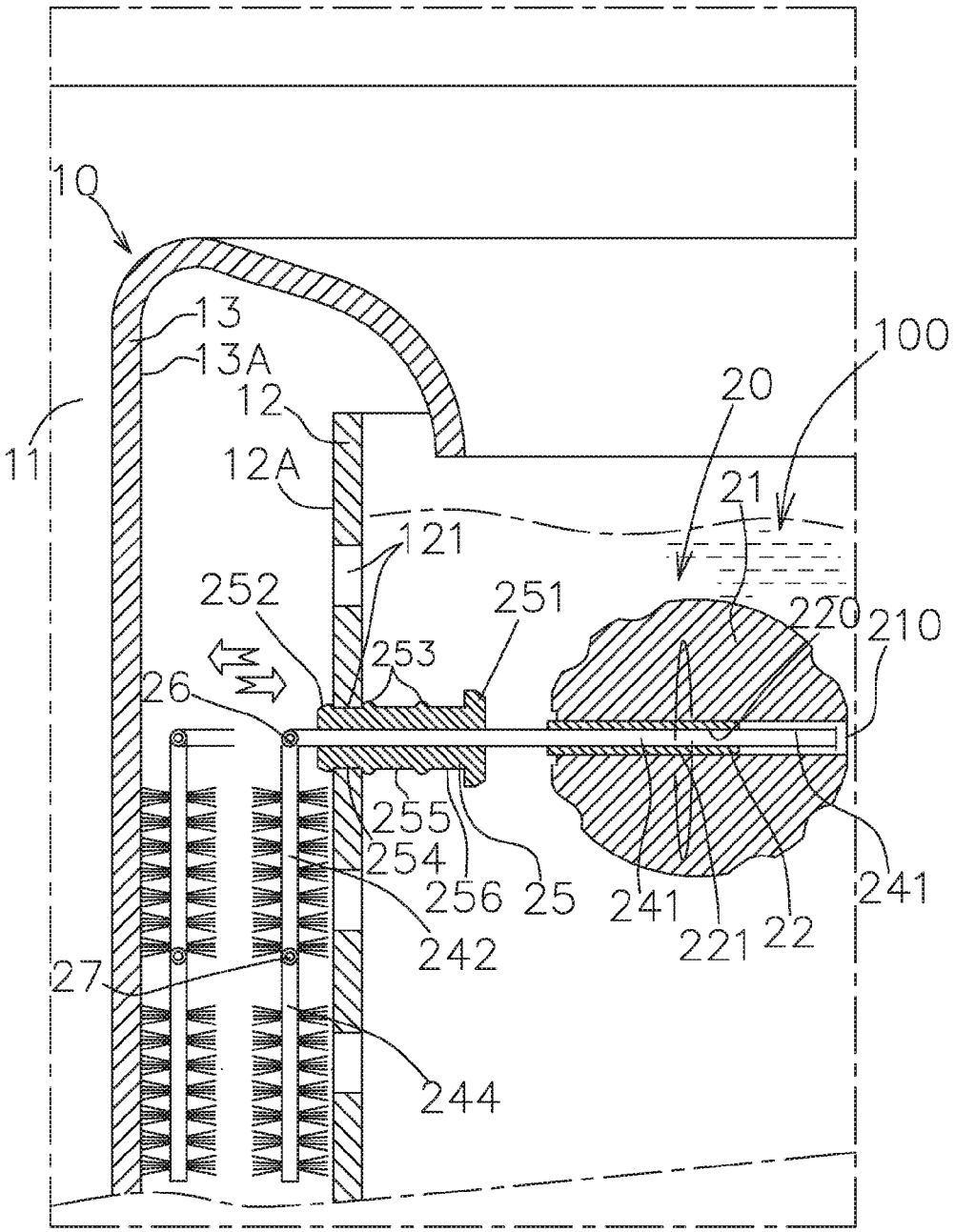
FIG. 10 is a sectional schematic view in accordance with a fourth embodiment of the present invention.

FIG. 10 illustrates the descaling device according to a fourth embodiment of the present invention. The fourth embodiment is substantially similar to the third embodiment with the exceptions described hereinafter. Another end of the descaling rod 242, opposite to the hinge 26, is provided with a second hinge 27, that is, the distal end of the descaling rod 242 is further provided with the second hinge 27. The second hinge 27 is pivotally connected with a second descaling rod 244. The second descaling rod 244 is a brush. In this way, the area descaled and cleaned by the descaling device 20 is increased.

Figure 11:
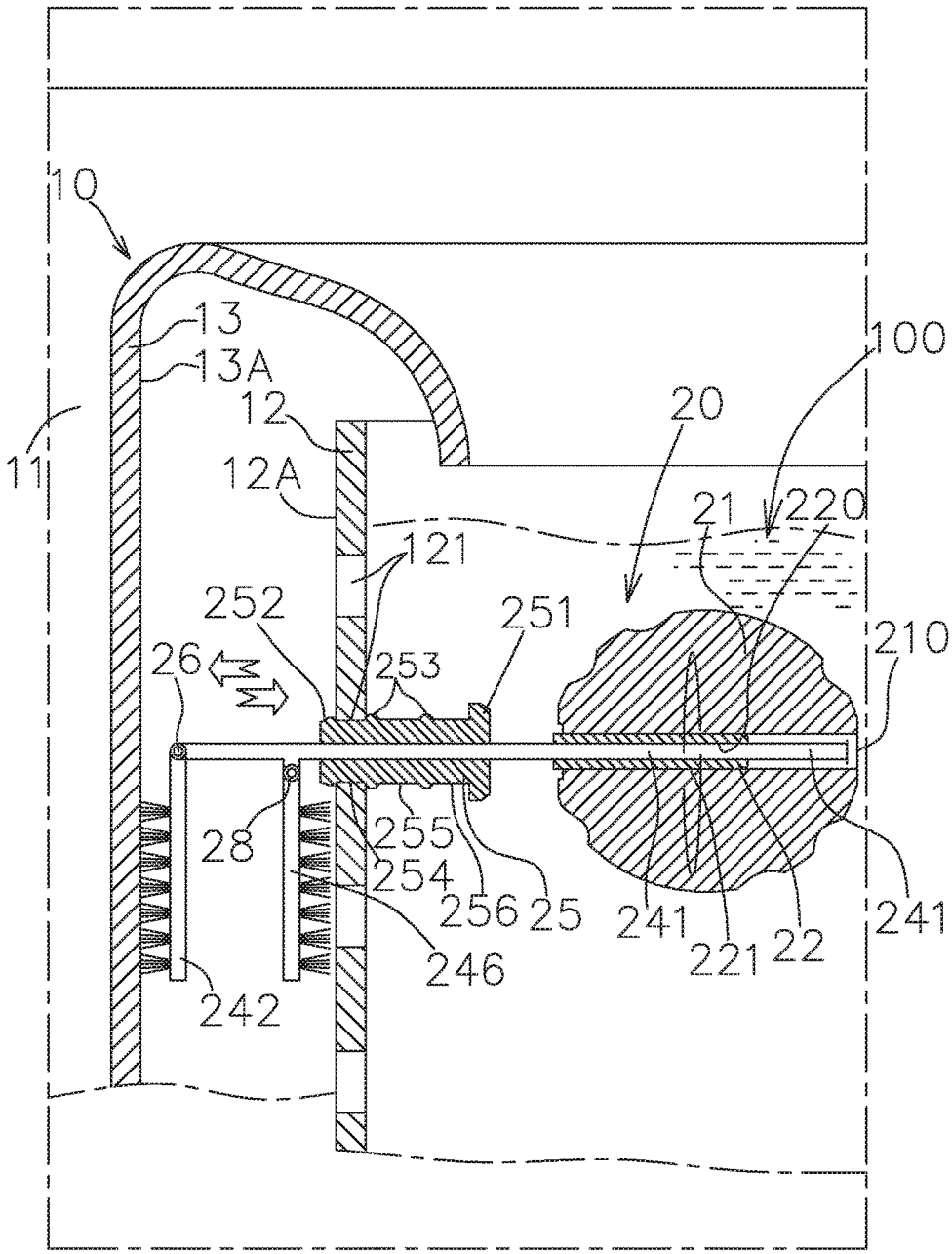
FIG. 11 is a sectional schematic view in accordance with a fifth embodiment of the present invention.

FIG. 11 illustrates the descaling device according to a fifth embodiment of the present invention. The fifth embodiment is substantially similar to the third embodiment with the exceptions described hereinafter. The connecting rod 241 is further connected with an auxiliary descaling rod 246 opposite an inner side of the descaling rod 242. The auxiliary descaling rod 246 is bent at an angle relative to the connecting rod 241. For example, the auxiliary descaling rod 246 is perpendicularly bent (90 degrees) relative to the connecting rod 241, but the angle of bending is not limited thereto. The auxiliary descaling rod 246 is bent and located in the space 14. The auxiliary descaling rod 246 is also a brush. Further, the auxiliary descaling rod 246 is provided with an auxiliary hinge 28 thereon. Preferably, the hinge 28 is disposed at an adjoining end of the auxiliary descaling rod 246 relative to the connecting rod 241, but not limited thereto, so that the auxiliary descaling rod 246 is in a pivot state. In this way, the auxiliary hinge 28 facilitates the descaling operation on the outer wall 12A of the inner tank 12 and further increases the area to be descaled and cleaned and the efficiency of the descaling device 20.

Figure 12:
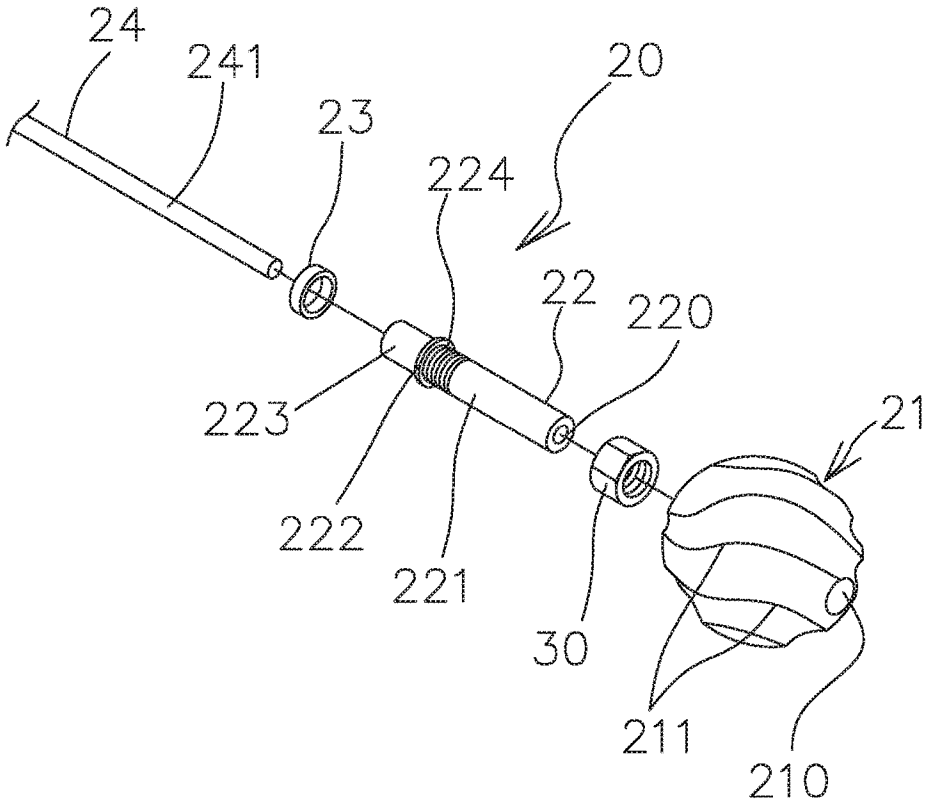
FIG. 12 is a partial exploded view in accordance with a sixth embodiment of the present invention.
Figure 13:
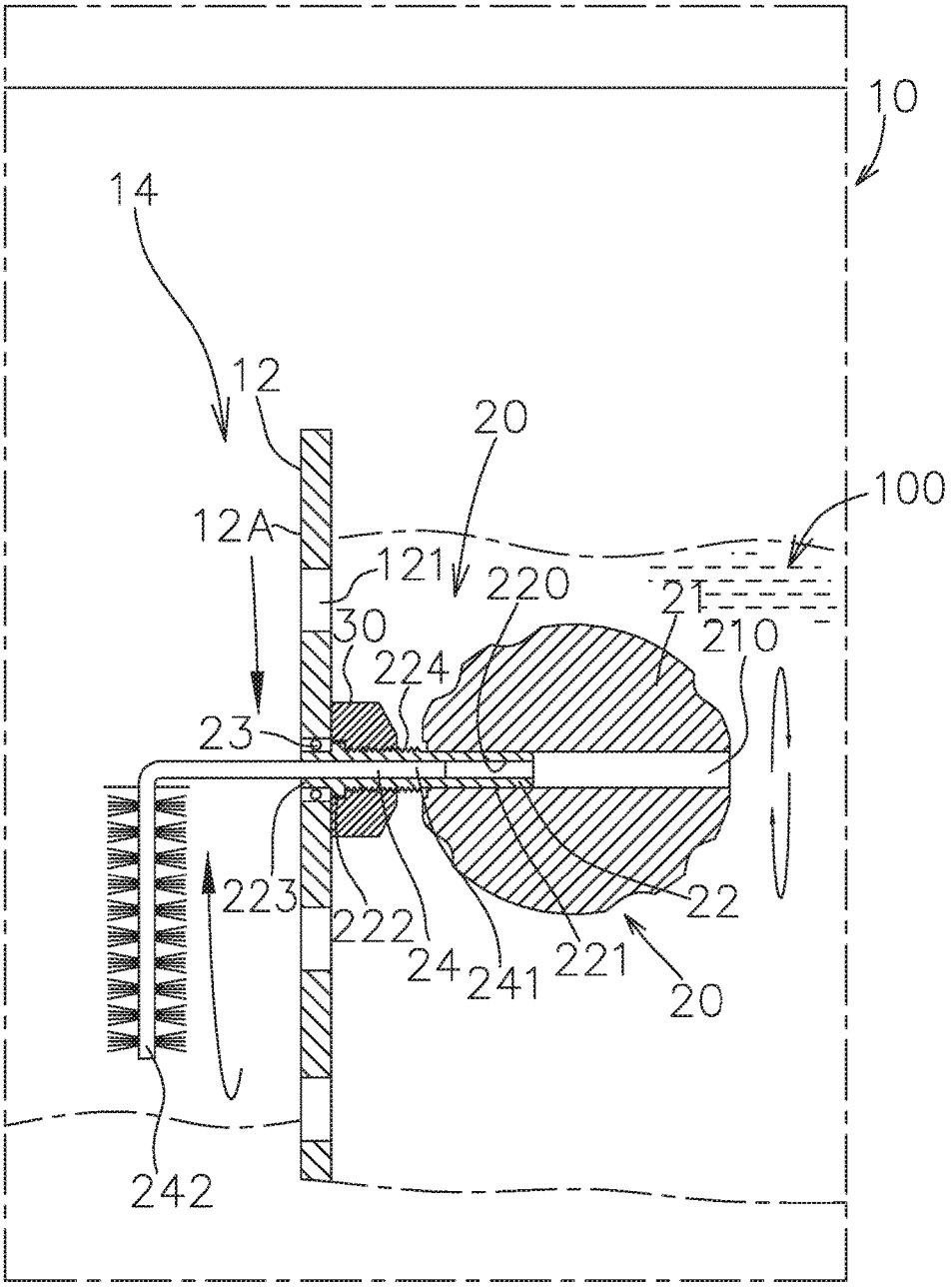
FIG. 13 is a sectional schematic view in accordance with the sixth embodiment of the present invention.

FIG. 12 and FIG. 13 illustrate the descaling device according to a sixth embodiment of the present invention. The sixth embodiment is designed based on the aforesaid embodiments with the exceptions described hereinafter. The connecting portion 221 is provided with an auxiliary fixing segment 224 adjacent to the annular engaging portion 222. In this embodiment, the auxiliary fixing segment 224 is a threaded segment, and an auxiliary fixing member 30 is provided corresponding to the auxiliary fixing segment 224. The auxiliary fixing member 30 is a hollow ring fitted on the connecting portion 221 to engage with or disengage from the auxiliary fixing segment 224. (In this embodiment, the auxiliary fixing member and the auxiliary fixing segment have corresponding threads.) When in use, the auxiliary fixing member 30 is screwed to lean against the inner wall of the inner tank 12, so that the main body 21 is not easily shaken by the impact of the water 100 when the main body 21 is turned in the inner tank 12 so as to form a more stable structure.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A descaling device of a washing machine, disposed in the washing machine for descaling and cleaning an inner tank and an outer tank of the washing machine, a predetermined space being defined between the inner tank and the outer tank, the descaling device comprising:

a main body, located in the inner tank, wherein the main body is lashed by water to rotate when in use; and a descaling assembly, including a connecting rod and a descaling rod which are connected to each other, the connecting rod being linked by the main body to rotate, the descaling rod being disposed in the space, the descaling rod being bent at an angle relative to the connecting rod, the descaling rod being provided with a brush, the descaling rod being linked by the connecting rod to rotate, the brush being adapted for descaling.

2. The descaling device as claimed in claim 1, wherein the brush is formed of a bristle brush, a sponge, or a fiber fabric.

3. The descaling device as claimed in claim 1, wherein the main body has a through hole therein.

4. The descaling device as claimed in claim 3, further comprising a shaft member, the shaft member being in a tubular shape and having a shaft hole, the shaft member being inserted in the through hole in a tightly engaged state, the connecting rod being inserted in the shaft hole, the connecting rod being extendable and retractable relative to the shaft hole through an external force.

5. The descaling device as claimed in claim 4, wherein the shaft member includes a connecting portion inserted in the through hole, the connecting portion is connected with an annular engaging portion, the annular engaging portion is connected with a pivot portion, and the shaft hole of the shaft member penetrates through the annular engaging portion, and the pivot portion.

6. The descaling device as claimed in claim 5, further comprising a bearing, the pivot portion being pivotally connected to the bearing.

7. The descaling device as claimed in claim 5, wherein the connecting portion is provided with an auxiliary fixing segment adjacent to the annular engaging portion, an auxiliary fixing member is provided corresponding to the auxiliary fixing segment, and the auxiliary fixing member is fitted on the connecting portion to engage with or disengage from the auxiliary fixing segment.

8. The descaling device as claimed in claim 4, further comprising an adjustment member, the adjustment member having a first raised ring and a second raised ring at inner and outer ends thereof, at least one engaging recess being formed between the first raised ring and the second raised ring for engaging with a perforation of the inner tank.

9. The descaling device as claimed in claim 1, wherein the main body includes a plurality of raised blades having a spiral curved shape.

10. The descaling device as claimed in claim 1, wherein the descaling rod is a multi-rod configuration for increasing descaling efficiency.

11. The descaling device as claimed in claim 1, wherein a hinge is connected between the connecting rod and the descaling rod, enabling the descaling rod to rotate or swing freely relative to the connecting rod.

12. The descaling device as claimed in claim 11, wherein another end of the descaling rod, opposite to the hinge, is provided with a second hinge, the second hinge is pivotally connected with a second descaling rod, and the second descaling rod is a brush.

13. The descaling device as claimed in claim 11, wherein the connecting rod is further connected with an auxiliary descaling rod opposite an inner side of the descaling rod, the auxiliary descaling rod is bent at an angle relative to the connecting rod, the auxiliary descaling rod is a brush, and the auxiliary descaling rod is provided with an auxiliary hinge disposed at an adjoining end of the auxiliary descaling rod relative to the connecting rod so that the auxiliary descaling rod is in a pivot state.

* * * * *